US006981327B2

(12) United States Patent
Nordlin

(10) Patent No.: US 6,981,327 B2
(45) Date of Patent: Jan. 3, 2006

(54) TWO PIECE PUNCH WITH PILOT HOLE LOCATOR

(75) Inventor: William F. Nordlin, Poplar Grove, IL (US)

(73) Assignee: Greenlee Textron Inc., Rockford, IL (US)

( * ) Notice: Subject to any disclaimer, the term of this patent is extended or adjusted under 35 U.S.C. 154(b) by 0 days.

(21) Appl. No.: 10/340,121

(22) Filed: Jan. 10, 2003

(65) Prior Publication Data

US 2004/0134325 A1 Jul. 15, 2004

(51) Int. Cl.
*B26F 1/02* (2006.01)

(52) U.S. Cl. ..... 30/360; 30/361; 30/366; 83/685; 83/686; 83/689

(58) Field of Classification Search ..... 30/358, 30/359, 360, 361, 362, 366, 367, 368, 229; 83/682, 684, 685, 686, 688, 689; 29/263, 29/264; 470/162
See application file for complete search history.

(56) References Cited

U.S. PATENT DOCUMENTS

| | | | | | |
|---|---|---|---|---|---|
| 161,968 | A | | 4/1875 | Kennedy | 83/689 |
| 1,721,007 | A | | 7/1929 | Doherty et al. | 30/360 |
| 1,817,223 | A | | 8/1931 | Abramson et al. | |
| 2,096,778 | A | * | 10/1937 | Azer | 30/360 |
| 2,145,725 | A | | 1/1939 | Jamleson | |
| 2,176,943 | A | * | 10/1939 | Reeser | 30/360 |
| 2,237,069 | A | | 1/1941 | Christenson | |
| 2,735,489 | A | * | 2/1956 | Fowler | 30/360 |
| 3,255,526 | A | | 6/1966 | Molitor | |
| 3,269,011 | A | * | 8/1966 | Herrstrum | 30/360 |
| 3,683,499 | A | | 8/1972 | Robinson, Jr. | 30/360 |
| 3,728,927 | A | | 4/1973 | Pfleiderer et al. | 83/621 |
| 3,800,419 | A | * | 4/1974 | Hughes, Jr. | 30/358 |
| 4,087,913 | A | | 5/1978 | Jackson | 30/360 |
| 4,353,164 | A | | 10/1982 | Linquist et al. | 30/360 |
| 4,403,417 | A | * | 9/1983 | Wilson et al. | 30/360 |
| 4,543,722 | A | | 10/1985 | Adleman et al. | 30/360 |
| 4,594,779 | A | | 6/1986 | Hagemeyer | 30/360 |
| 4,724,616 | A | | 2/1988 | Adleman et al. | 30/360 |
| 4,739,687 | A | | 4/1988 | Wanner et al. | 83/688 |
| 4,830,548 | A | | 5/1989 | Kandarian | |
| 4,899,447 | A | | 2/1990 | Adleman | 30/360 |
| 4,905,557 | A | | 3/1990 | Adleman | 83/681 |
| 5,029,392 | A | | 7/1991 | Bingham et al. | 30/360 |
| 5,727,436 | A | | 3/1998 | Swedberg et al. | 83/686 |

FOREIGN PATENT DOCUMENTS

| | | |
|---|---|---|
| DE | 19613153 | 10/1997 |
| DE | 19803814 | 8/1999 |

OTHER PUBLICATIONS

Five pages from Greenlee Catalog No. 79 issued in Sep. 1979—Timesaving Tools for Electricians, Maintenance, Men and Industry.
Ten pages from Greenlee Catalog MA–1024—Nov. 1993—Tools Testers, and Accessories.

* cited by examiner

*Primary Examiner*—Clark F. Dexter
(74) *Attorney, Agent, or Firm*—Trexler, Bushnell, Giangiorgi, Blackstone & Marr, Ltd.

(57) ABSTRACT

A two piece punch is provided for use in a punch assembly. The punch includes a generally disc shaped cutter and a cylindrically shaped nut. The punch is assembled by passing a portion of the nut through an aperture in the cutter. The punch is mounted to the remainder of the punch assembly by fastening the nut to the draw stud. As the punch becomes worn, use of the nut continues while the cutter is removed and replaced.

20 Claims, 6 Drawing Sheets

TWO PIECE PUNCH WITH PILOT HOLE LOCATOR

BACKGROUND OF THE INVENTION

The present invention relates to an improved punch which is used in conjunction with a punch driver to punch holes in a work piece, such as for example, sheet metal, aluminum, fiberglass and plastic.

Generally, when a hole is to be punched in a work piece, a small pilot hole is first drilled in the work piece. A punch assembly is then used to create a hole of the desired dimensions in the work piece. A prior art punch assembly 10 is shown in FIG. 1. The punch assembly 10 includes a die 12, a punch 14, and a draw stud 16. A first end 18 of a draw stud 16 is threaded into a ram 20 of a hydraulic punch driver 21. The operator locates the punch assembly 10 in the pilot hole 24 by using "alignment marks". A second end 22 of the draw stud 16 is inserted through the die 12 and then through the drilled pilot hole 24 in the work piece 26, the draw stud 16 having a circumference that is less than the circumference of the drilled hole 24. The punch 14 is threaded onto the second end 22 of the draw stud 16 on the opposite side of the work piece 26 from the die 12 and the driver 21. An operator actuates a hydraulic punch driver 21. When the hydraulic punch driver 21 is actuated, hydraulic fluid forces the ram 20 to pull the draw stud 18. The draw stud 18, in turn, pulls the punch 14 through the work piece 26 into the die 12 such that the desired hole is punched in the work piece 26.

Punch assemblies used in the prior art suffer from a number of disadvantages. One such disadvantage is that the prior art punch assemblies do not provide means for locating the punch assembly in the pilot hole as the punch and the die are drawn together by the draw stud to make a hole in the workpiece. The alignment marks currently used to align the punch assembly with the pilot hole can be difficult to see by the operator and may allow for error such that the hole to be created may not be properly positioned.

Another disadvantage of prior art punch assemblies is that a significant amount of material is used to manufacture the punch which adds to the expense of the punch assembly.

Yet another disadvantage of the prior art punch assemblies is that the process for forming the punch can be very costly.

An even further disadvantage of the prior art punch assemblies is that the punch is costly to replace as it becomes worn after use.

Thus, it is desirable to have a punch assembly which incorporates the advantages of the prior art punches, but which overcomes the disadvantages of the prior art punch assemblies, such as those identified above. The invention, as described herein, provides such a punch assembly. Other features and advantages of the punch assembly of the present invention will become apparent upon a reading of the attached specification in combination with a study of the drawings.

OBJECTS AND SUMMARY OF THE INVENTION

A primary object of the invention is to provide a punch which improves punch alignment over prior art punches, such as the current difficult to see alignment marks.

An object of the invention is to provide a punch which is lower in cost to manufacture than those found in the prior art.

Yet another object of the invention is to provide a punch which can be replaced more economically than punches found in the prior art.

Briefly, and in accordance with the foregoing, a punch is provided which includes two pieces, a nut and a cutter. One end of the nut is passed through an aperture in the cutter and the draw stud is threadedly engaged with the nut. The nut also functions as a pilot hole locator such that when the punch and the die are drawn together by the draw stud to make a hole in a workpiece, the pilot hole locator on the nut locates the punch assembly in the pilot hole.

BRIEF DESCRIPTION OF THE DRAWINGS

The features of the present invention which are believed to be novel are described in detail hereinbelow. The organization and manner of the structure and operation of the invention, together with further objects and advantages thereof, may best be understood by reference to the following description taken in connection with the accompanying drawings wherein like reference numerals identify like elements in which.

DETAILED DESCRIPTION OF THE ILLUSTRATED EMBODIMENT

Figure 1:
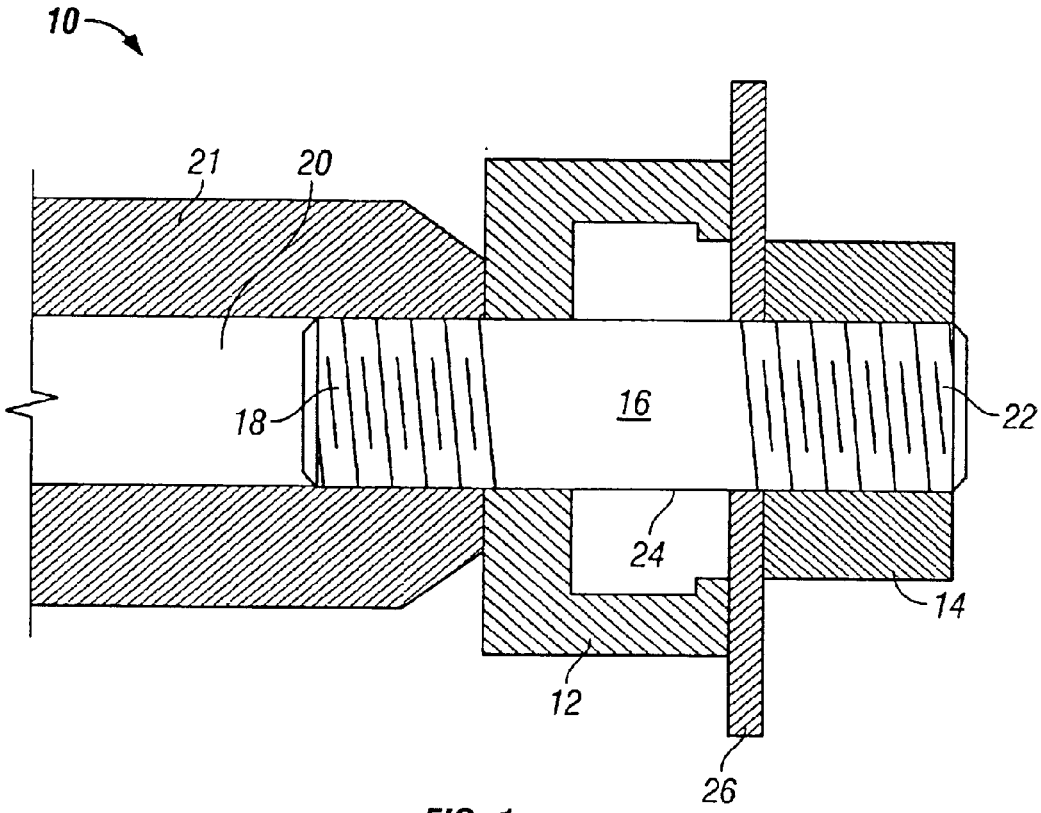
FIG. 1 (Prior Art)
FIG. 1 is an elevated view of a prior art punch assembly.
Figure 2:
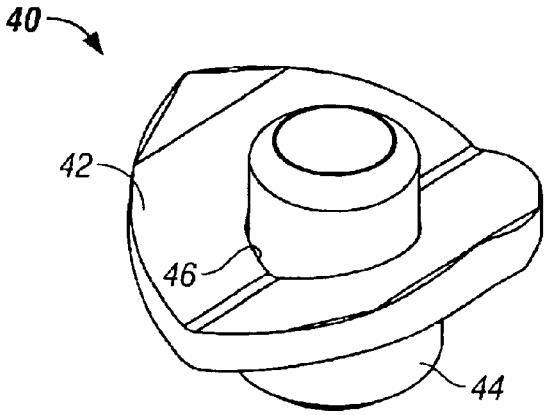
FIG. 2 is a perspective view of the punch of the present invention, the punch being formed of a nut and a cutter.
Figure 3:
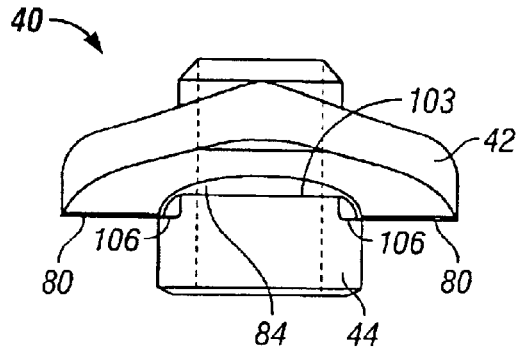
FIG. 3 is a side-elevational view of the punch of FIG. 2.
Figure 4:
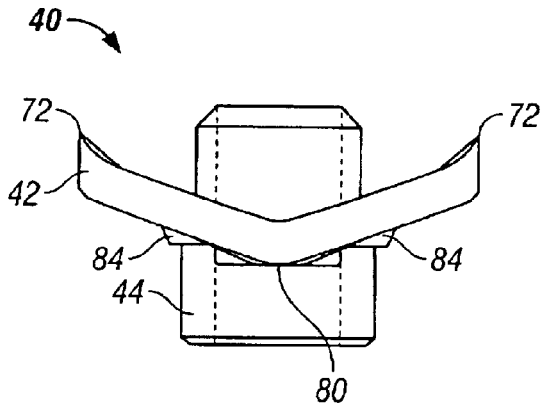
FIG. 4 is another side-elevational view of the punch of FIG. 2.
Figure 5:
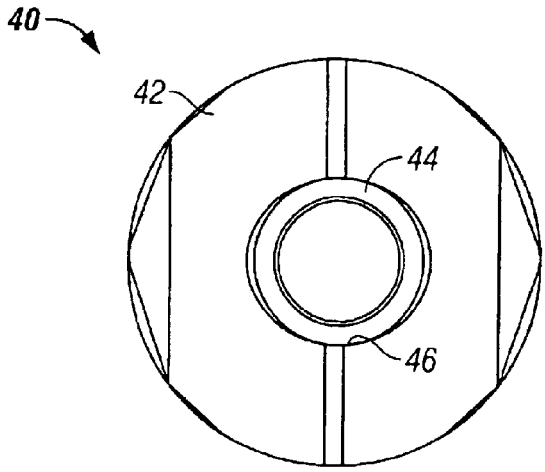
FIG. 5 is a top plan view of the punch of FIG. 2.
Figure 6:
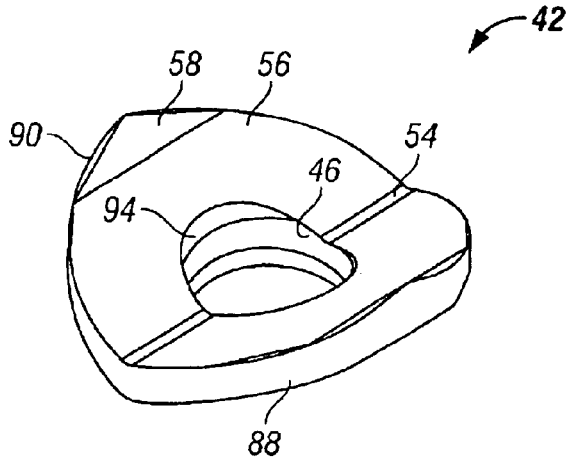
FIG. 6 is a perspective view of one embodiment of the cutter of the present invention.

While this invention may be susceptible to embodiment in different forms, there is shown in the drawings and will be described herein in detail, specific embodiments with the understanding that the present disclosure is to be considered an exemplification of the principles of the invention, and is not intended to limit the invention to that as illustrated.

A punch 40 is provided and illustrated in FIGS. 2–5. The punch 40 is useful for punching a hole through a workpiece (not shown). The punch 40 is used with a die (not shown) which is well known in the art as well as a draw stud (not shown) which is also well known in the art. A first end of the draw stud is typically threaded to a ram (not shown) of a punch driver (not shown). A second end of the draw stud is inserted through the die, and through a pilot hole (not shown) which is provided in the workpiece (not shown), the draw stud having a circumference that is less than the circumference of the pilot hole. The punch 40 is then attached to the second end of the draw stud on the opposite side of the workpiece than is the die and the hydraulic punch driver as will be described herein. In describing the punch 40 of the present invention, elements more closely located to the driver will be described as proximal and elements located further from the driver will be described as distal.

The punch 40 generally includes a cutter 42 and a nut 44. The cutter 42 is generally disc shaped with a circular aperture 46 located through the axial center of the cutter 42. The cutter 42 can be made from carbon or alloy steel, for example. In the preferred embodiment a surface hardness of Rc 53–58 and a minimum core hardness of Rc 40 are achieved. The cutter 42 can be formed, for example, by stamping, investment casting, die casting, cold heading or forging for minimal piece cost and tooling economy.

The nut 44 is generally cylindrical. The nut 44 is preferably made from metal and is preferably treated by quenching and tempering. The nut 44 is slip fit to the cutter 42 by positioning the nut 44 within the aperture 46 of the cutter 42.

A first embodiment of the cutter 42 is shown in FIGS. 2–8. A second embodiment of the cutter is shown in FIGS. 14–18.

The first embodiment of the cutter 42 is best illustrated in FIGS. 6–9. The cutter 42 generally includes a proximal surface 50, a distal surface 52 and the circular aperture 46. The proximal surface 50 will be positioned proximate the workpiece to be cut. As viewed in a plan view (FIG. 9), the cutter 42 is generally circular. The proximal surface 50 of the cutter 42 includes center surfaces 54, first inclined surfaces 56 and second inclined surface 58.

Figure 9:
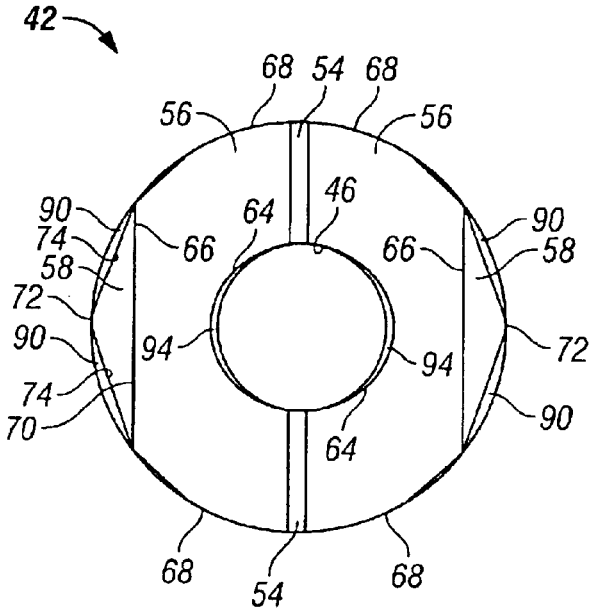
FIG. 9 is a top plan view of the cutter of FIG. 6.
Figure 10:
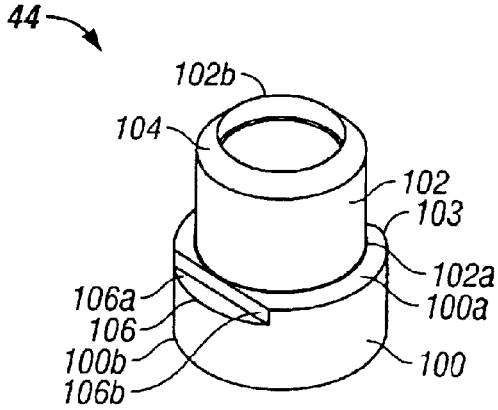
FIG. 10 is a perspective view of the nut of the present invention.
Figure 11:
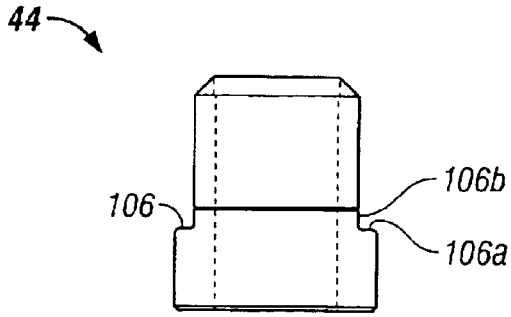
FIG. 11 is a side-elevational view of the nut of FIG. 10.
Figure 12:
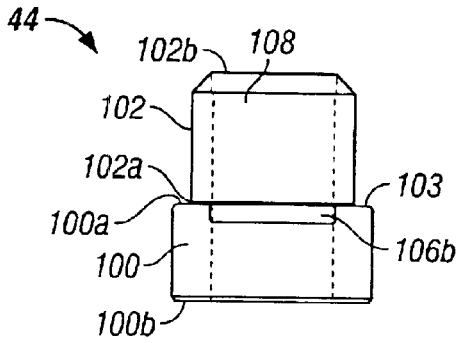
FIG. 12 is another side-elevational view of the nut of FIG. 10.

As best shown in FIG. 9, the center surfaces 54 extend from opposite sides of the perimeter of the aperture 46 to the perimeter of the proximal surface 50. The first inclined surfaces 56 are generally arch shaped and are diametrically opposed. Each first inclined surface includes an inner edge 64, an outer edge 66, and cutting edges 68. The inner edges 64 of each of the first inclined surfaces 56 are generally C-shaped and abut center surfaces 54 and the aperture 46. Each outer edge 66 is spaced from the aperture 46 and is generally parallel to the center surfaces 54. The cutting edges 68 are arcuate and extend along the perimeter of the proximal surface 50 from the center surfaces 54 to the outer edge 66.

The second inclined surfaces 58 are generally triangularly shaped. Each second inclined surface 58 includes an inner edge 70, an outer piercing tip 72 and cutting edges 74. Each inner edge 70 abuts a respective one of the outer edges 66 of the first inclined surfaces 56. Each tip 72 is spaced from the respective inner edge 70 and positioned on the perimeter of the proximal surface 50. The cutting edges 74 of each of the surfaces 58 extend from opposite ends of the inner edges 70 and join at the respective tips 72.

Figure 7:
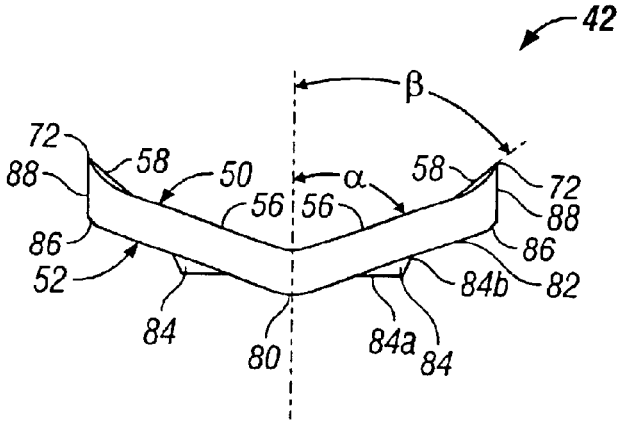
FIG. 7 is a side-elevational view of the cutter of FIG. 6.

The first inclined surfaces 56 slope upwardly (as shown in FIG. 7) from the axial center of the cutter 42 in opposite directions at an angle $\propto$. In the preferred embodiment, the angle $\propto$ is approximately 70°. The second inclined surfaces 58 slope upwardly from the first inclined surfaces 56 at an angle $\beta$. In the preferred embodiment, the angle $\beta$ is approximately 45°.

Figure 8:
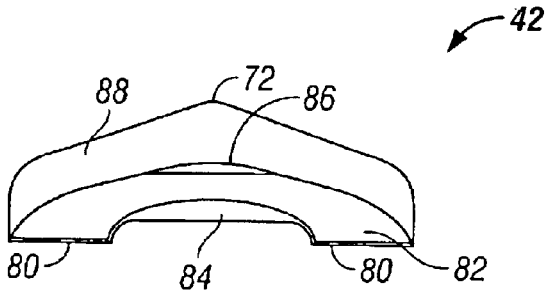
FIG. 8 is another side-elevational view of the cutter of FIG. 6.

As best shown in FIGS. 7 and 8, the distal surface 52 of cutter 42 includes center portions 80, first inclined surfaces 82, seat portions 84, and second inclined surfaces 86. The center portions 80 are diametrically opposed and extend from the aperture 46 to the perimeter of the distal surface 52. The center portions 80 are generally parallel to the center surfaces 54 of the proximal surface 50 and perpendicular to the axial center of the cutter 42. The first inclined surfaces 82 are generally arched and abut the center portions 80 and the aperture 46. The first inclined surfaces 82 extend radially outwardly from the center portions 80, generally parallel to the first inclined surfaces 56 of the proximal surface 50. The seat portions 84 extend outwardly from the first inclined surfaces 82. The seat portions 84 include first walls 84*a* and second walls 84*b*. The first walls 84*a* of the seat portions 84 are generally perpendicular to the axial center line of the cutter 42. The second walls 84*b* extend from the outer ends of the first walls 84*a* and are generally perpendicular to the first walls 84*a* and parallel to the axial center line of the cutter 42. The second inclined surfaces 86 extend from the first inclined surfaces 82 to the perimeter of the distal surface 52.

An end surface 88 connects the proximal surface 50 to the distal surface 52. The end surface 88 includes beveled portions 90 proximate the tips 72.

As best shown in FIG. 9, the cutter 42 includes diametrically opposed chamfers 94 proximate the aperture 46. Alternatively, the chamfers 94 can be eliminated from the cutter 42.

As shown in FIGS. 10–13, the nut 44 includes a generally cylindrically shaped first portion 100 and a generally cylindrically shaped second portion 102. The first portion 100 includes a fixed end 100*a* and a free end 100*b*. The second portion 102 includes a fixed end 102*a* and a free end 102*b*. The fixed end 100*a* of the first portion 100 abuts the fixed end 102*a* of the second portion 102. The outer diameter of the first portion 100 is larger than the outer diameter of the second portion 102. The outer diameter of the second portion 102 is smaller than the diameter of the pilot hole to be drilled in the workpiece. A tapered surface 104 is provided on the free end 102*b* of the second portion 102.

Figure 13:
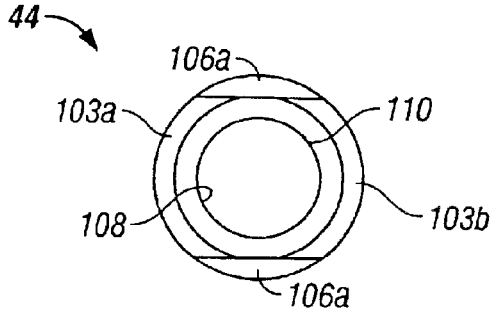
FIG. 13 is a top plan view of the nut of FIG. 10.
Figure 14:
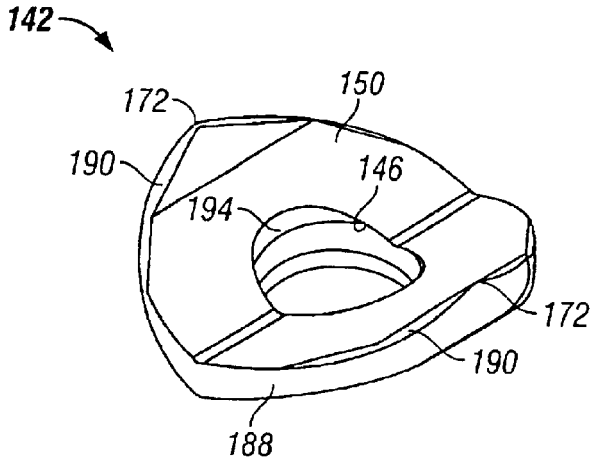
FIG. 14 is a perspective view of an alternative embodiment of the cutter of the present invention.

A driving surface 103 is provided by the first portion 100, proximate the fixed end 100*a*. Diametrically opposed shoulders 106 are also provided proximate the fixed end 100*a* of the first portion 100. As best shown in FIG. 13, the driving surface 103 includes two arch shaped portions 103*a*, 103*b*. Each arch shaped portion 103*a*, 103*b* extends from the perimeter of the first portion 100 to the perimeter of the second portion 102 and between the shoulders 106. Each shoulder 106 includes a first surface 106*a* parallel to and spaced from the driving surface 103 and a second surface 106*b* perpendicular to the first surface 106*a* and extending from the first surface 106*a* to perimeter of the first portion 100.

A passageway 108 is provided through the axial center of the nut 44. A thread 110 is provided on the inner wall of the passageway 108 for joining the nut 44 with the draw stud as will be described herein.

The second embodiment of the cutter is shown in FIGS. 14–18. The cutter 142 includes a proximal surface 150, a distal surface 152 and a circular aperture 146. The proximal surface 150 will be positioned proximate the workpiece to be cut. As viewed in a plan view (FIG. 17), the cutter 142 is generally circular. The proximal surface 150 of the cutter 142 includes center surfaces 154, first inclined surfaces 156, and second inclined surface 158.

Figure 17:
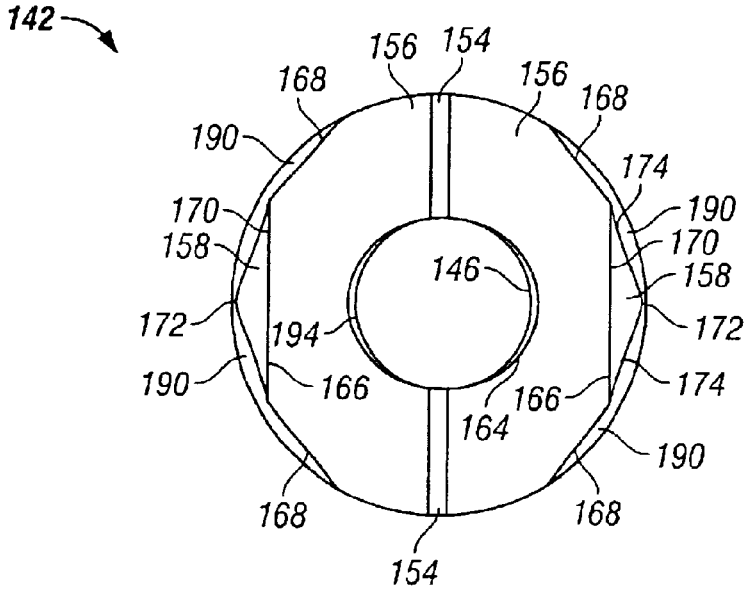
FIG. 17 is a top plan view of the cutter of FIG. 14.

As best shown in FIG. 17, the center surfaces 154 extend from opposite sides of the perimeter of the aperture 146 to the perimeter of the proximal surface 150. Each first inclined surface 156 includes an inner edge 164, an outer edge 166, and cutting edges 168. The inner edges 164 of each of the first inclined surfaces 156 are generally C-shaped and abut center surfaces 154 and the aperture 146. Each outer edge 166 is spaced from the aperture 146 and is generally parallel to the center surfaces 154. The cutting edges 168 extend along the perimeter of the proximal surface 150 from the center surfaces 154 to the outer edge 166.

The second inclined surfaces 158 are generally triangularly shaped. Each second inclined surface includes an inner edge 170 an outer piercing tip 172, and cutting edges 174. Each inner edge 170 abuts a respective one of the outer edge 166 of the first inclined surface 156. Each tip 172 is spaced from the respective inner edge 170 and positioned on the perimeter of the proximal surface 150. The cutting edges 174 extend from opposite ends of each inner edge 170 and join at the respective tips 172.

The first inclined surfaces 156 slope upwardly from the axial center of the cutter 142 in opposite directions at an angle $\propto$. In the preferred embodiment, the angle $\propto$ is approximately 70°.

The second inclined surfaces 158 slope upwardly from the first inclined surfaces 156 at an angle $\beta$. In the preferred embodiment, the angle $\beta$ from the axial center of the cutter 142 to each second inclined surface 158 is approximately 45°.

Figure 16:
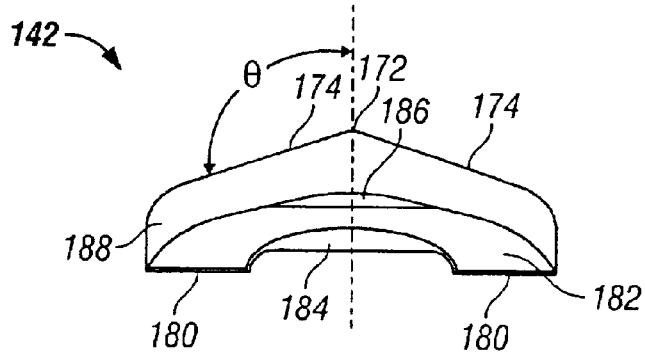
FIG. 16 is another side-elevational view of the cutter of FIG. 14.

The cutting edges 174 slope upwardly toward each tip 172. As shown in FIG. 16, an angle $\theta$ is provided between the axial center of the cutter 142 and the cutting edges 172. In the preferred embodiment the angle $\theta$ is approximately 108°.

Figure 15:
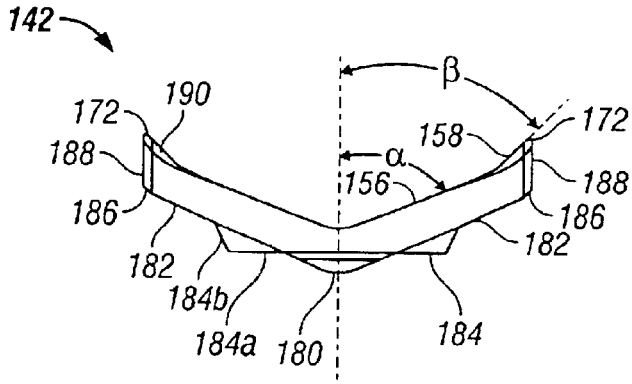
FIG. 15 is a side-elevational view of the cutter of FIG. 14.
Figure 18:
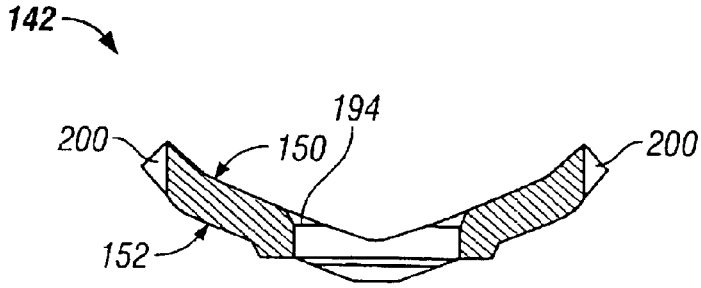
FIG. 18 is a cross-sectional view of the cutter of FIG. 14 along the line 18—18 of FIG. 14.

As best shown in FIGS. 15, 16 and 18, the distal surface 152 of cutter 142 includes center portions 180, first inclined surfaces 182, seat portions 184, and second inclined surfaces 186. The center portions 180 are diametrically opposed and extend from the aperture 146 to the perimeter of the distal surface 152. The center portions 180 are generally parallel to the center surfaces 154 of the proximal surface 150 and perpendicular to the axial center of the cutter 142. The first inclined surfaces 182, as shown in FIG. 16, are generally arched and abut the center portions 180 and the aperture 146. The first inclined surfaces 182 extend radially outwardly from the center portions 180, generally parallel to the first inclined surfaces 156 of the proximal surface 150. The seat portions 184 extend outwardly from the first inclined surfaces 182. The seat portions 184 include first walls 184*a* and second walls 184*b*. The first walls 184 are generally perpendicular to the axial center line of the cutter 142. The second walls 184*b* extend from the outer ends of the first walls 184*a* and are generally perpendicular to the first walls 184*a* and are generally parallel to the axial center line of the cutter 142. The second inclined surfaces 186 extend outwardly from the first inclined surfaces 182 to the perimeter of the distal surface 152.

An end surface 188 connects the proximal surface 150 of the cutter 142 to the distal surface 152 of the cutter 42. The end surface 188 includes beveled portions 190 proximate the tips 172.

As best shown in FIGS. 17 and 18, the cutter 142 includes diametrically opposed chamfers 194 proximate the aperture 146. Alternatively, the chamfers 194 can be eliminated from the cutter 142.

As shown in phantom line in FIG. 18, end surfaces 200 can be provided which extend from the end surfaces 188 of the cutter 142. Unlike the end surfaces 188 which are generally perpendicular to the axial center of the cutter 142, the end surfaces 200 are angled relative to the axial center of the cutter 142.

Assembly of the two piece punch 40 will now be described. To begin, the operator selects a cutter, for example, cutter 42 which corresponds to the dimension of the hole to be cut. To assemble the two piece punch 40, the nut 44 is positioned proximate the distal side 52 of the cutter 42. The second portion 102 of the nut 44 is then passed through the aperture 46 of the cutter 42. The cutter 42 is then rotated on the nut 44 in such a manner that the center surfaces 54 of the cutter 42 are aligned with the shoulders 106 of the nut 44. The operator continues to pass the nut 44 through the cutter 42 until the distal surface of the cutter 42 engages the nut 44. In particular, the center portions 80 of the distal surface 52 of the cutter 42 contact the first surfaces 106*a* of the shoulders 106 and the seat portions 184 of distal surfaces 82 of the cutter 42 contact the driving surfaces 103*a*, 103*b* of the nut 44. Upon assembly of the cutter 42 and nut 44, the inner wall of the aperture 46 of the cutter 42 will engage with the second surfaces 106*b* of the shoulders 106 to prevent the cutter 42 from rotating relative to the nut 44.

Assembly of the punch 40 with the remainder of the punch assembly will now be discussed. As explained above, an operator threads a proximal end of the draw stud to a ram of a punch driver. The distal end of the draw stud is passed through a die and through a pilot hole which is provided in a workpiece, the draw stud having a circumference which is less than the circumference of the pilot hole. The punch 40 is then attached to the distal end of the draw stud on the opposite side of the workpiece than is the die and the hydraulic punch driver. The punch 40 is attached to the draw stud by threading the second end of the draw stud into the threaded passageway 108 of the nut 44.

The operator then turns the punch 40 onto the draw stud until the punch 40 and the die fit snugly against the workpiece and the tapered surface 104 of the nut 44 enters the pilot hole and causes the punch 40, the draw stud and die to center on the pilot hole. The operator could also actuate a hydraulic punch driver until the punch and the die are snug against the workpiece.

After the tapered surface 104 of the nut 44 enters the pilot hole to center the punch 40, the operate actuates the hydraulic punch driver such that hydraulic fluid forces the ram to pull the draw stud, which in turn pulls the nut 44 of punch 40. The driving surface 103 of the nut 44 pushes on the distal surface of the cutter 42 such that the tips 72 of the cutter 42 pierce the workpiece and the cutting edges 68, 74 cut the workpiece along the perimeter of the cutter 42. As a result, a hole is created which has a diameter equivalent to the diameter of the proximal surface 50 of the cutter 42 and which is larger than the pilot hole.

The configuration of the punch 40, in comparison to punches of the prior art, reduces the initial piercing force by reducing the area of contact between the punch 40 and the workpiece. Due to the angle $\beta$ of the piercing tips 72, the piercing tips 72 substantially pass through the workpiece before the cutting edges 68, 74 begin cutting the hole. Upon passage of the nut 44 through the workpiece, a hole having the desired dimensions is cut.

Several advantages are provided by the two piece punch 40. One such advantage is that the operator does not have to use alignment marks to center the punch 40. Rather, the operator simply places that tapered surface of the nut 44 within the pilot hole. When the operator actuates the hydraulic punch driver, the punch 40, draw stud and die will center on the pilot hole, eliminating alignment errors.

Another advantage of the punch 40 of the present invention is that the operator can vary the size of the hole formed by the punch 40 by simply selecting a cutter 42 with the desired diameter dimensions. Thus, multiple sized cutters 42 can be used with a single nut 44.

Yet another advantage of the present invention is the ability to economically replace the cutter 42. After extended use of the punch assembly, the punch 40 becomes worn and must be replaced in order for the punch assembly to effectively cut the workpiece. A significant amount of material is used to make the punches of the prior art. In addition, the process of threading the interior surface of the prior art punches is costly. Due to the amount of material and the processes used to form the prior art punches, replacement of the prior art punches is costly. The two piece punch 40 of the present invention includes the nut 44 having the internal thread 110 and the cutter 42 which does not have a threaded portion. When the cutter 42 of the punch 40 becomes worn, only the cutter 42 of the punch 40 must be replaced, not the nut 44. Thus, significantly less material is replaced than with the prior art punches. As no threading is required on the cutter 42 of the punch 40, the cutter 42 can be economically stamped. Although, the cutter 42 of the punch 40 is replaced, the nut 44 portion of the punch 40, which includes the threaded portion 110, can continue to be used.

In an alternative embodiment, the cutter 42 of the punch 40 could include a proximal/working surface similar to the punch sold under the tradename SLUG BUSTER®. In such an embodiment, the portion of the workpiece which has been cut away to form the hole (i.e. the slug) is broken in to multiple pieces for easy removal of the slug from the die.

While preferred embodiments of the present invention are shown and described, it is envisioned that those skilled in the art may devise various modifications of the present invention without departing from the spirit and scope of the appended claims.

The invention is claimed as follows:

1. A punch adapted to be mounted on a draw stud and for cutting a hole in a workpiece, said punch comprising:

a cutter including a distal surface, a proximal surface, an aperture through said cutter extending from said distal surface to said proximal surface, said proximal surface being used to form a hole in a workpiece and having a forwardmost end defined thereby;

a nut removably mounted to said cutter, said nut including a first portion, a second portion and means for engaging a draw stud with said nut, a perimeter of said first portion is larger than a perimeter of said second portion; and said cutter is assembled with said nut by passing said second portion of said nut through said aperture in said cutter, an end portion of said second portion of said nut extending beyond said forwardmost end of said cutter when said cutter is assembled with said nut.

2. A punch as defined in claim 1, wherein said means for engaging a draw stud with said nut includes a passageway through said nut and a thread along at least a portion of said passageway.

3. A punch as defined in claim 1, wherein said first portion of said nut further includes shoulders, said cutter engages said shoulders and the movement of said cutter relative to said nut is limited by said engagement of said cutter and said shoulders.

4. A punch as defined in claim 1, wherein said second portion of said nut includes a free end and wherein a tapered surface is provided on said free end of said second portion.

5. A punch as defined in claim 1, wherein said proximal surface includes tips for piercing a workpiece, said tips defining said forwardmost end.

6. A punch as defined in claim 5, wherein said cutter includes an axial center and said proximal surface includes first inclined surfaces on diametrically opposed sides thereof, wherein said first inclined surfaces include cutting edges.

7. A punch as defined in claim 6, wherein said first inclined surfaces are angled at approximately 70 degrees relative to said axial center of said cutter.

8. A punch as defined in claim 6, further including second inclined surfaces extending from said first inclined surfaces and wherein said second inclined surfaces include cutting edges.

9. A punch as defined in claim 8, wherein said second inclined surfaces are angled at approximately 45 degrees relative to said axial center of said cutter.

10. A punch as defined in claim 1, wherein said cutter includes an axial center and said proximal surface includes first inclined surfaces on diametrically opposed sides thereof, wherein said first inclined surfaces include cutting edges.

11. A punch as defined in claim 10, wherein said first inclined surfaces are angled at approximately 70 degrees relative to said axial center of said cutter.

12. A punch as defined in claim 10, further including second inclined surfaces extending from said first inclined surfaces and wherein said second inclined surfaces include cutting edges.

13. A punch as defined in claim 12, wherein said second inclined surfaces are angled at approximately 45 degrees relative to said axial center of said cutter.

14. A punch as defined in claim 1, wherein said cutter is press fit to said nut.

15. A punch as defined in claim 1, wherein said distal surface of said cutter further includes a seat portion and wherein said seat portion engages with said first portion of said nut.

16. A punch adapted to be mounted on a draw stud and for cutting a hole in a workpiece, said punch comprising:

a cutter including an aperture therethrough, and a surface which is used to form a hole in a workpiece, said surface having a forwardmost end; and a nut removably engaged with said cutter by passing said nut through said aperture, a portion of said nut extending beyond said forwardmost end of said cutter when said nut is engaged with said cutter, said nut including means for engaging a draw stud.

17. A punch as described in claim 16, wherein said nut is capable of receiving a variety of cutters.

18. A punch as defined in claim 16, wherein said means for engaging a draw stud includes a passageway through said nut and a thread along at least a portion of said passageway.

19. A punch as defined in claim 16, further including means for limiting rotation of said cutter relative to said nut.

20. A punch as defined in claim 16, wherein said surface includes tips for piercing a workpiece, said tips defining said forwardmost end.

* * * * *